US006490798B2

(12) United States Patent
Morisugi et al.

(10) Patent No.: US 6,490,798 B2
(45) Date of Patent: Dec. 10, 2002

(54) BLADE BLOCK OF A HAIR CUTTER

(75) Inventors: Kazuhiro Morisugi, Inukami-gun (JP); Yuuji Yamagishi, Neyagawa (JP)

(73) Assignee: Matsushita Electric Works, Ltd., Osaka (JP)

( * ) Notice: Subject to any disclaimer, the term of this patent is extended or adjusted under 35 U.S.C. 154(b) by 0 days.

(21) Appl. No.: 09/768,401

(22) Filed: Jan. 25, 2001

(65) Prior Publication Data

US 2001/0009068 A1 Jul. 26, 2001

(30) Foreign Application Priority Data

Jan. 26, 2000 (JP) ..... 2000-016407

(51) Int. Cl.[7] ..... B26B 19/06

(52) U.S. Cl. ..... 30/216; 30/223

(58) Field of Search ..... 30/223, 216, 34.1, 30/43.92, 224

(56) References Cited

U.S. PATENT DOCUMENTS

| | | | | |
|---|---|---|---|---|
| 1,329,675 A | * | 2/1920 | Niland | 30/223 |
| 3,869,790 A | * | 3/1975 | Ihasz | 30/43.92 |
| 4,249,307 A | | 2/1981 | Andis | |
| 4,813,133 A | | 3/1989 | Locke et al. | |
| 4,899,444 A | | 2/1990 | Trichell et al. | |
| 5,579,581 A | | 12/1996 | Melton | |

* cited by examiner

*Primary Examiner*—Douglas D. Watts
(74) *Attorney, Agent, or Firm*—Greenblum & Bernstein, P.L.C.

(57) ABSTRACT

A blade block of a hair cutter including a fixed blade, a movable blade reciprocating with respect to the fixed blade, and a blade base to which the fixed blade and the movable blade are attached. The fixed blade and the movable blade are assembled with a reciprocating guide unit into a blade unit. The reciprocating guide unit guides the movable blade to reciprocate with respect to the fixed blade. The blade block include an insertion opening. A mounting unit is provided to mount the blade unit to the blade base by inserting the blade unit into the insertion opening so that a cutting edge is exposed to the outside of the blade block.

19 Claims, 12 Drawing Sheets

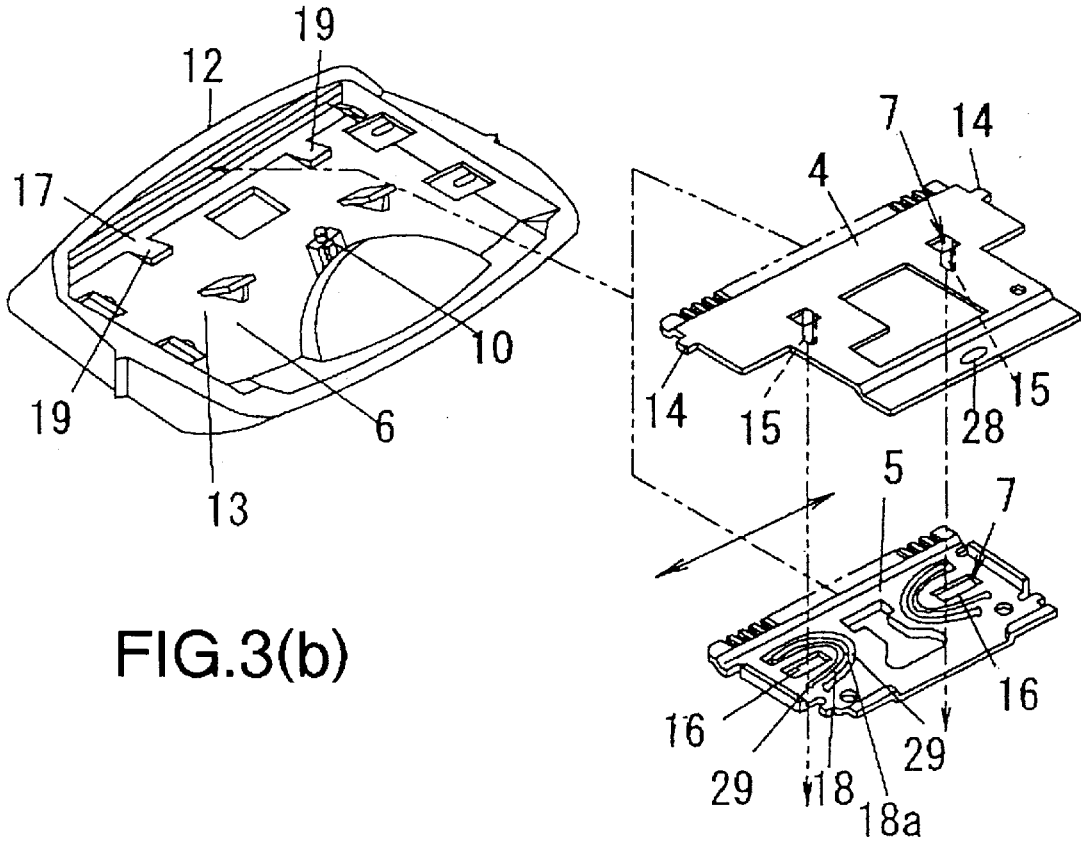
FIG.3(b)
FIG.3(c)
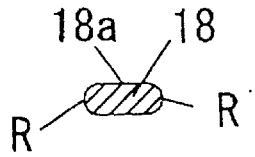

PRIOR ART

PRIOR ART

BLADE BLOCK OF A HAIR CUTTER

BACKGROUND OF THE INVENTION

1. Field of Invention

This invention relates to a blade or cutting block of a hair cutter or shaver. In particular, the present invention relates to a blade block structure and technique to reduce a cost of the blade block and to improve an efficiency of assembling the blade block of hair cutter.

2. Description of Related Art

Conventionally, as shown in FIGS. 15(*a*) and 15(*b*), a blade block Aa is constructed by mounting a movable blade 5 on a blade base 6 so as to reciprocate with respect to a fixed blade 4. The blade block Aa is detachably mounted onto a body of a hair cutter or shaver. The fixed blade 4 having a comb-like portion is brought into contact with the movable blade 5 via a spring 18, and a cover 20 fixes or secures the fixed blade 4 and the movable blade 5 to the blade base 6. A guide mechanism is provided to reciprocate the movable blade 5 with respect to the fixed blade 4 is constructed as follows. Guide members 21 project from the blade base 6, and are inserted into insertion holes 4*a* and 5*a* formed in the fixed blade 4 and the movable blade 5, respectively. A driving force is transmitted from a drive mechanism in the body of the hair cutter to the movable blade 5, so that the movable blade 5 reciprocates within the range of the elongated insertion hole 5*a*.

Further, the movable blade 5 is pressed toward and against the fixed blade 4 by a spring portion, which is separate from the movable blade 5, and is mounted to the blade base 6.

The blade block Aa as described above is detachably mounted to the body of the hair cutter. In particular, in a medical hair cutter (such as is used e.g. to prepare a patient for a medical procedure by shaving the hair from a portion of the patient's body), the blade block Aa, including the blade base 6, the fixed blade 4 and movable blade 5 and so on, which directly contact a human skin is disposable and is not used more than once, to ensure safety and sanitariness. Accordingly, it is desired to reduce a cost and to improve efficiency of assembling of the blade block Aa.

On the other hand, in the conventional blade block structure of the hair cutter, the number of parts is large and the process for assembling the blade block is inefficient.

Accordingly, the present invention is provided in view of the above-described problems. It is an objective of the present invention to provide a blade block of a hair cutter, in which the number of parts are reduced to improve the efficiency of assembly of the blade block of the hair cutter, and automated assembly can easily be achieved, and the cost can be reduced.

SUMMARY OF THE INVENTION

To achieve the above and/or other goals, the present invention provides a blade block of a hair cutter that is detachably mountable to a hair cutter body. The blade block includes a fixed blade and a movable blade that reciprocates with respect to the fixed blade. The blade block includes a blade unit, a blade base and a mounting unit. The blade unit includes the fixed blade and the movable blade coupled by a reciprocating guide that enables the movable blade to reciprocate with respect to the fixed blade. The blade base defines an insertion opening. The mounting unit enables the blade unit to be mounted to the blade base when the blade unit is inserted into the insertion opening, so that a cutting edge of the blade unit extends toward and is exposed to the outside or exterior of the blade block.

According to the construction described above, the fixed blade and the movable blade are assembled into the blade unit by using the reciprocating guide. The blade unit is inserted into the insertion opening of the blade base, and is fixed to the blade base by the mounting unit in a condition or orientation such that the cutting edge extends toward outside of the blade block. Thus, the number of parts can be reduced in comparison with the conventional construction, and assembling of the blade block can be automated. Thus, the cost of manufacturing the blade block can be reduced. In addition, since the reciprocating guide is provided between the fixed blade and the movable blade, where machining precision can easily be achieved, the precision of the reciprocating guide function of the movable blade can be easily improved, and sharpness of the blade unit is easily maintained.

Preferably, a skin contact surface is provided at an outer surface of the blade base, and the cutting edge of the blade unit, inserted into the insertion opening, is inclined with respect to the skin contact surface. According to and as a result of this structure and construction, even if the blade base has a certain thickness, the cutting edge is not separated from and can tightly and closely contact the skin. Thus, even hair that might otherwise easily escape from the cutting edge, such as downy hair, can be held and cut short.

Preferably, the blade base includes a base plate, a wall portion provided at a periphery of the base plate and a corner portion formed between the base plate and the wall portion. The insertion opening is provided in a vicinity of the corner portion. The blade base is slidably detachably mounted to the hair cutter body. According to this construction, since the blade unit is inserted into the insertion opening provided in the vicinity of the corner portion, the cutting edge can be closely applied to the skin. Further, since the blade base is slidably attached to and detached from the hair cutter body, the blade block can easily be attached and detached by using a single hand.

Further, at least one stopper to position the fixed blade with respect to the blade base can be provided at each opposite side edge of the fixed blade. According to this construction, the blade unit can be securely supported against a load or force in the lateral direction of the fixed blade, in other words, in the reciprocating direction of the movable blade. Thus, a mounting strength (i.e., structural rigidity) of the blade unit can be improved.

Further, it is preferable that the fixed blade includes at least one guide piece, preferably formed by cutting and bending, so as to enable the movable blade to reciprocate. According to this construction, for example, the guide piece can be formed at the same time that the fixed blade is manufactured (e.g. by pressed or stamped). Thus, the guide piece can be formed easily and with improved precision.

The guide piece can extend in parallel with a reciprocating direction of the movable blade, so that the guide piece guides the movable blade surface contact with the movable blade while the movable blade reciprocates. According to this construction, the guiding of the movable blade in the reciprocating direction is satisfactorily performed by the guide piece extending in parallel with the reciprocating movement direction of the movable blade. In addition, the strength of the blade block due to the thickness of the guide piece can suppress backlash in a direction toward the cutting edge. Thus, the guiding precision can be improved. Further, since the guide piece extends in parallel with the reciprocating movement direction of the movable blade, and a broken (cut) face of the guide piece does not contact the edge of the guide hole, the roughness of the broken (cut) face of the guide piece does not affect the guiding function.

Preferably, a plurality of guide pieces extend in parallel with each other and are spaced from each other in a direction perpendicular to the reciprocating movement direction of the movable blade. According to this structure, the strength of the guide pieces against the force toward the cutting edge can substantially double. In addition, since a plurality of guide pieces are provided in parallel with each other, each guide piece does not require high size precision. Thus, the size precision does not have to be manufactured with a high precision (i.e. to size tolerance is high).

Alternatively, the guide piece can extend in a direction perpendicular to the reciprocating movement direction of the movable blade. The opposite edges of the guide piece, in a width direction thereof, slidably contact facing edges spaced in the width direction of a guide hole provided in the movable blade. According to this construction, since the guide piece can be guided at opposite edges in the width direction, its strength in a direction toward the cutting edge can be sufficiently improved. Further, the strength to support the movable blade against loads or forces at the time of cutting hair can be improved, and backlash can be avoided.

Further, the movable blade can have a guide hole that is elongated in the reciprocating movement direction, and a widened opening at one end of the guide hole. A stopper portion is further provided at a tip of the guide piece. The stopper portion is smaller than the widened opening and is larger than a width of the guide hole. According to this construction, the stopper portion can be inserted into the guide hole through the widened portion. Thus, the fixed blade is prevented from separating from the movable blade, and thus, the blade unit is prevented from falling apart.

The reciprocating guide can include a guide hole provided in the movable blade, a guide piece projecting from the fixed blade and slidably movable with respect to the guide hole, and a bent portion provided at an edge of the guide hole. According to this construction, since the bent portion provided at an edge of the guide hole slidably contacts the guide piece, the guide piece does not contact and is not guided by a broken (cut) edge of the guide hole. Thus, the guiding function becomes stable and unusual noise is prevented from occurring.

The guide piece and the bent portion of the guide hole can extend in opposite directions so as to face each other. According to this construction, since the guide piece is guided by the bent portion, which faces and slidably contacts the guide piece, the height of the guide piece can be shortened, and thus, the thickness of the blade unit can be decreased. In addition, since the bent portion extends toward the guide piece, the blade base does not require a portion into which the bent portion extends.

Further, for example, when the facing bent portions, provided at the opposing edges of the guide hole, are bent by more than 90 degrees, a sharp taper can be provided toward the bent portion (i.e. the movable blade). Thus, the efficiency of assembling the blade block can be improved, when the opposing bent portions engage with the guide pieces, which face the bent portions.

Alternatively, the guide piece and the bent portion of the guide hole can extend in a same direction. According to this structure, an introducing area for the guide piece can be formed naturally and simultaneously with a bent surface formed at the bent portion of the guide hole.

In addition, when the bending angle of the facing bent portions are less than 90 degrees, an amount of press fitting (bending) of the facing guide pieces can be set (or adjusted) to obtain a predetermined guiding function. Accordingly, the guide piece and the guide hole do not require high precision in their size and enable manufacturing with large tolerances.

It is preferable to further include an insertion guide portion provided on the blade base. The insertion guide portion guides the blade unit when the blade unit is assembled to the blade base by insertion of the blade unit into the insertion opening of the blade base. According to this construction, a positioning operation of the blade unit can be easily performed by the insertion guide portion formed on the blade base. Thus, efficiency of assembling of the blade unit can be improved.

It is preferable to further include a spring provided in the blade unit and an introducing portion provided on the blade base to introduce the spring to the blade base. According to this construction, when the blade unit is assembled with the blade base, the spring is prevented from deformation, which might occur when the spring is hooked by the blade base. On the contrary, the blade base is prevented from being scraped by the spring. Thus, the predetermined set pressing force of the spring is not changed, the assembling can be stable (i.e. not prone to error), and the movable blade can be stably pressed toward the fixed blade.

Preferably, the spring includes a flat portion, and corners of a peripheral surface of the spring are rounded or beveled. According to this structure, when the blade unit is inserted into the insertion opening of the blade base so as to be assembled with each other, the spring is easily slidable at the flat portion. Thus, the blade unit can be easily assembled to the blade base. In addition, since the corners of the peripheral surface of the spring are rounded or beveled, the spring is prevented from deformation, which might occur when the spring is hooked by the blade base. On the contrary, the blade base is prevented from being scraped by the spring. Thus, the predetermined or preset pressing force of the spring is not changed, the assembling can be stable, and the movable blade is stably pressed toward the fixed blade. Further, even when the spring is unitarily formed with the movable blade as one piece or connected with the movable blade, i.e., when the movable blade and the spring move together, the spring does not scrape the blade base and is not hooked by the blade base. Thus, driving of the movable blade can be made stable.

According to another aspect of the present invention, a blade block of a hair cutter includes a fixed blade and a movable blade which reciprocates with respect to the fixed blade. The blade block which is detachably mounted to a hair cutter body, is provided with a reciprocating guide including at least one guide piece projecting from the fixed blade, and at least one guide hole provided in the movable blade. The at least one guide piece is inserted into the at least one guide hole so that the movable blade can reciprocate within the range defined by the reciprocating hole. According to this construction, the guide piece can be unitarily formed with the fixed blade as one piece. Thus, the construction of the reciprocating guide can be simplified.

BRIEF DESCRIPTION OF THE DRAWINGS

The present invention is further described in the detailed description which follows, with reference to the noted plurality of drawings by way of non-limiting examples of exemplary embodiments of the present invention, in which like reference numerals represent similar parts throughout the several views of the drawings, and wherein.

DETAILED DESCRIPTION OF PREFERRED EMBODIMENTS

Figure 1:
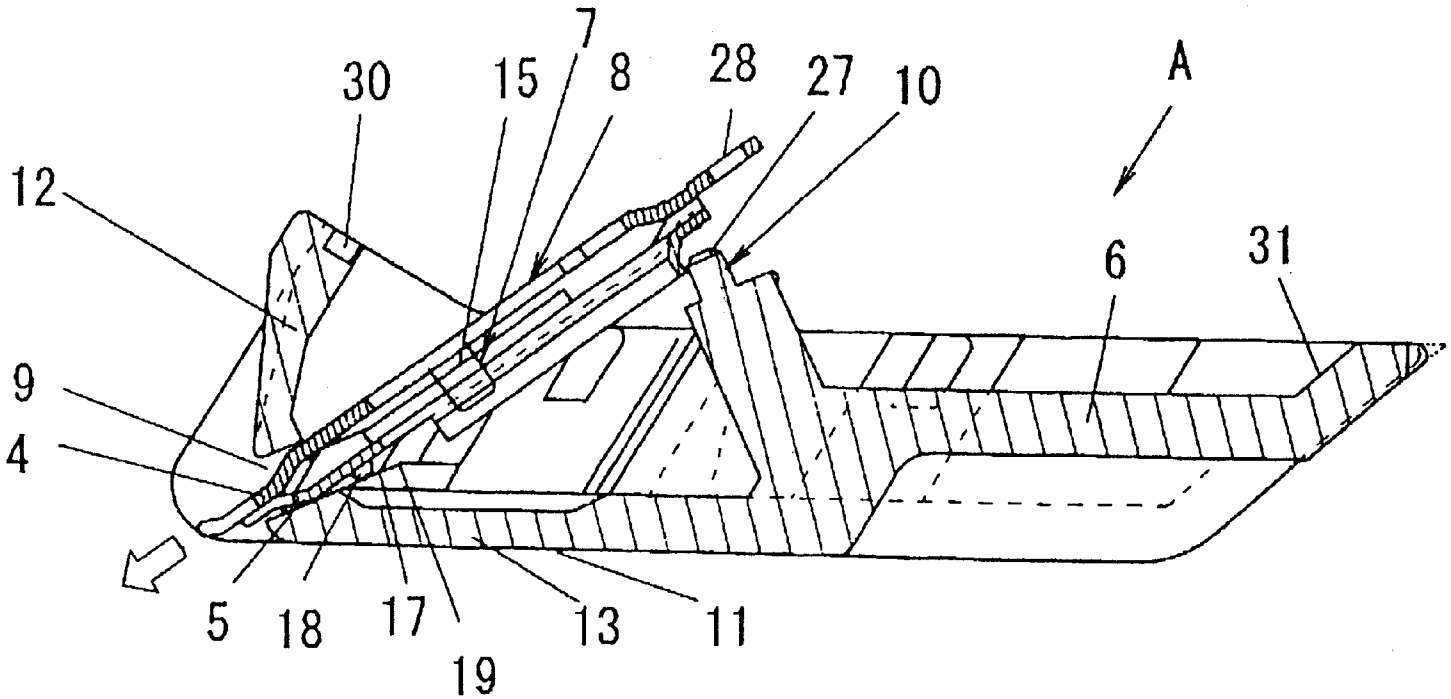
FIG. 1 is a cross-sectional view of a blade block according to a first embodiment of the present invention.
Figure 2:
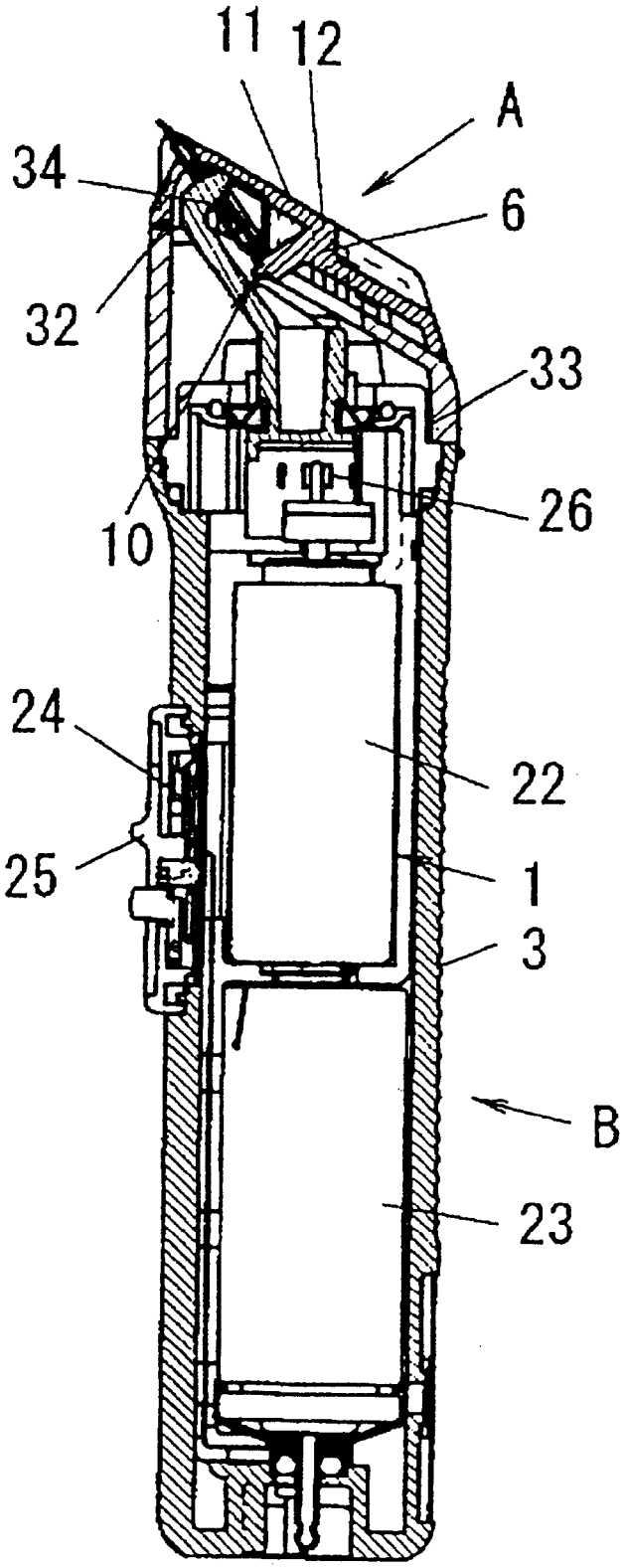
FIG. 2 is a cross-sectional view of a hair cutter to which the blade block shown in FIG. 1 is connected.

Embodiments of the present invention are explained in the following with respect to the figures. FIG. 1 is a cross-sectional view of a blade block, FIG. 2 is a cross-sectional view of a hair cutter to which the blade block of FIG. 1 is connected, FIG. 3(*a*) is a perspective view of the blade block viewed from inside of the blade block, and FIG. 3(*b*) is an exploded perspective view of the blade block.

A hair cutter B includes a hair cutter body 3 and a blade block A, which is detachably mounted to an upper end portion of the hair cutter body 3. A motor 22, a driving unit 1, a power source battery 23, a circuit unit 24, and so on, are provided in the hair cutter body 3. The blade block A is formed by a fixed blade 4, which is a comb-shaped cutting blade, and a movable blade 5 mounted to a blade base 6. The hair cutter body 3 includes a slide switch 25. When the slide switch 25 is slidingly moved, a power source is switched on, and thus a rotational force output from the motor 22 is transformed and transmitted to the movable blade 5 as a reciprocative driving force via a driving transmission mechanism 26 and a transmission element 34. Thus, the movable blade 5 reciprocates with respect to the fixed blade 4 so as to enable the comb-shaped cutting blade to cut hair and so on. Hereinafter, the blade block A is explained in detail.

Guide pieces 15 are provided on the fixed blade 4, and guide holes 16 are formed in the movable blade 5. The guide pieces 15 are inserted into the guide holes 16 so as to enable the movable blade 5 to move reciprocatingly with respect to the fixed blade 4 and to be guided by the coaction of the guide pieces 15 and the guide holes 16. The guide pieces 15 are formed on the fixed blade 4 by cutting and bending. Thus, the fixed blade 4 and the movable blade 5 are assembled with a reciprocating guide 7, which includes the guide pieces 15 and the guide holes 16, into a blade unit 8.

Thus, the guide pieces 15 are formed at the same time when the fixed blade 4 is formed, e.g., by stamping. Accordingly, the guide pieces 15 can be easily formed with improved precision.

A skin contact surface 11 is provided at an outer surface of the blade base 6, and a wall portion 12 is provided at a periphery of a base plate 13 of the blade base 6. Further, an insertion opening hole 9 is formed in or at the vicinity of a corner portion of the blade base. The portion is formed between the base plate 13 and the wall portion 12. A fixing boss 27 is formed on an extension of the central axis (i.e. along a center line) of the insertion opening 9. The fixed blade 4 is provided with a fixing hole 28. The fixing boss 27 and the fixing hole 28 make up a mounting unit 10.

The blade unit 8 is inserted into the insertion opening 9 so that the cutting edge of the blade extends to the outside, and the fixing boss 27 is inserted into the fixing hole 28 to attach and mount the blade unit 8 to the blade base 6.

Thus, the cutting edge of the blade unit 8, inserted into the insertion opening 9, is inclined with respect to the skin contact surface 11. Thus, even if the blade base 6 has a certain thickness, the cutting edge of the blade is not separated or spaced from the skin, and can tightly and closely contact the skin. Accordingly, hair, such as downy hair, which might otherwise easily escape from the blade, can be introduced into the blade and can be cut short. Further, since the blade unit 8 is inserted into the insertion opening 9, which is provided in or at the vicinity of the corner portion of the blade base 6, the cutting edge of the blade can be positioned so much closer to the skin.

Figure 3A:
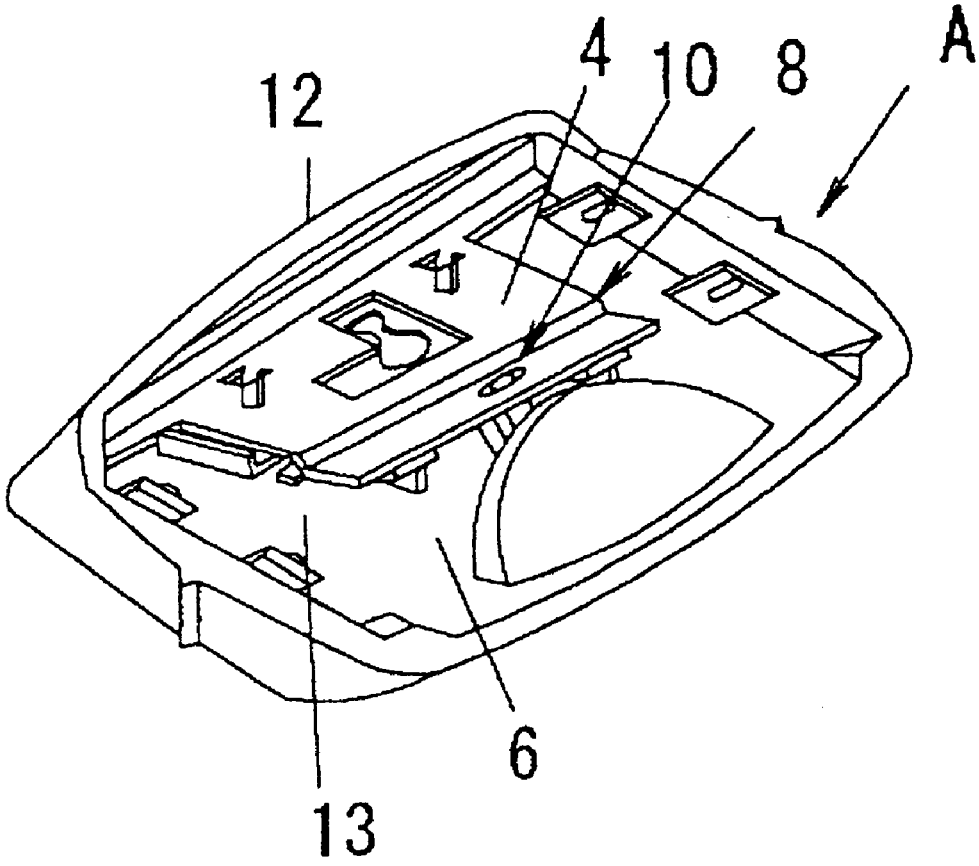
FIGS. 3(*a*), 3(*b*) and 3(*c*), respectively, are a perspective view taken from inside of the blade block, an exploded perspective view of the blade block, and a cross-sectional view of a spring according to the first embodiment of the present invention.
Figure 4A:
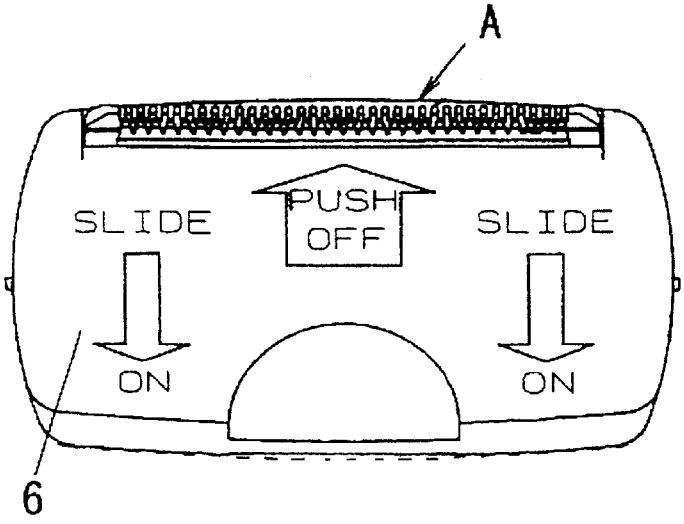
FIGS. 4(*a*) and 4(*b*), respectively, are a front elevation view, and a cross-sectional view of the blade block according to the first embodiment of the present invention.
Figure 4B:
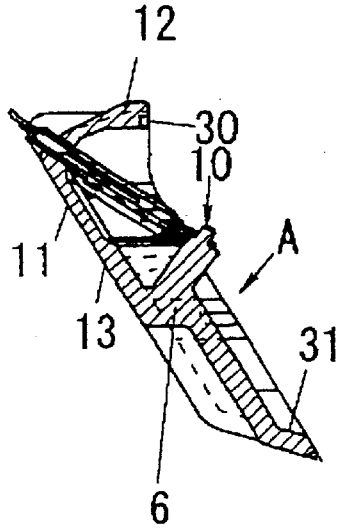
Figure 5:
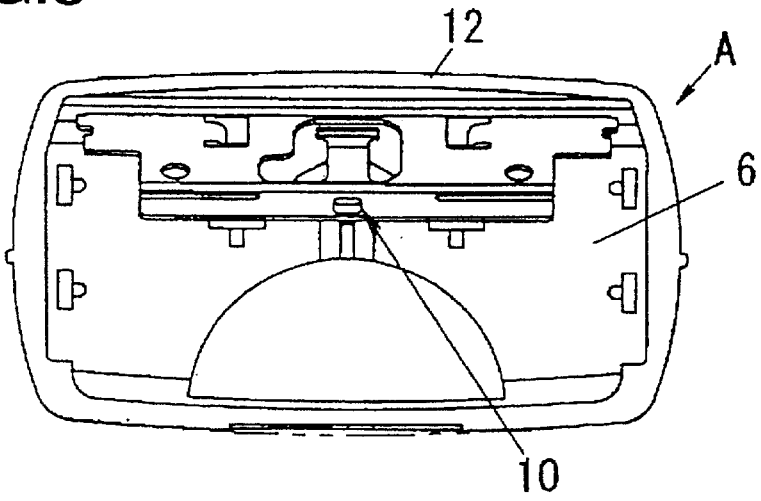
FIG. 5 is a rear elevation view of the blade block according to the first embodiment of the present invention.

In addition, as shown in FIG. 3(*b*), stopper portions 14 are formed at the opposite ends of the fixed blade 4 to position the fixed blade 4 with respect to the blade base 6. Thus, the blade unit 8 is securely supported against the load in the lateral direction of the fixed blade 4. In other words, the blade unit 8 is supported in the direction of the reciprocating movement of the movable blade 5. Thus, the mounting strength of the blade unit 8 can be improved.

Two kerfs (or slots) 29 are formed in the movable blade 5 and a spring 18 is formed between the two kerfs 29. The spring 18 includes a flat surface portion 18*a* and the corners on the peripheral side surfaces of the spring 18 are rounded to provide beveling R. The blade base 6 includes an introducing portion 19 that introduces (i.e., position and orients) the spring 18 with respect to the blade base 6. Thus, when the blade unit 8 is installed in the blade base 6, deformation of the spring 18 caused by being hooked or snagged by the blade base 6 can be avoided. Furthermore, the spring 18 does not scrape the blade base 6, and the predetermined design pressing force exerted by the spring 18 does not change.

Thus, assembling of the unit becomes simplified and does not give rise to assembly errors and the movable blade 5 can be securely pressed to the fixed blade 4. Further, the movable blade 5 and the spring 18 are unitarily formed as one piece. Accordingly, even when the movable blade 5 and the spring 18 integrally move as one piece, the movable blade 5 and the spring 18 do not scrape the blade base 6, or are not hooked by the blade base 6. Thus, drive of the movable blade 5 can be carried out without mistake or error.

A recessed portion 30 is formed in the back (inner) side at the front end of the blade base 6, and a slide mounting surface 31 is formed in the back (inner) side at the rear end of the blade base 6. The hair cutter body 3 includes a protrusion 32 and a slide support surface 33. Thus, the recessed portion 30 of the blade base 6 engages with the protrusion 32 of the hair cutter body 3, and the slide mounting surface 31 is slid into the slide support surface 33 to engage with each other. Thus, since the blade base 6 is slid into the hair cutter body 3 to engage with each other, the blade base 6 can be easily attached to or detached from the hair cutter body 3 by using a single hand. It is possible to modify the design of the structure to slide the blade base 6 so as to be attached to or detached from the hair cutter body 3.

As described above, according to the present invention and as illustrated in FIG. 3(*a*), the fixed blade 4 and the movable blade 5 are assembled with the reciprocating guide 7 into a blade unit 8. The blade unit 8 is inserted into the insertion opening 9 of the blade base 6 so that the cutting edge of the blade projects toward the outside, the blade unit 8 is fixed to the blade base 6 by use of the mounting unit 10. Thus, compared with the conventional construction, the number of parts can be reduced, and automatic assembly can be achieved. Thus, the manufacturing and assembly costs can be reduced. In addition, the reciprocating guide 7 is formed between the fixed blade 4 and the movable blade 5 where high machining precision can be easily achieved. Thus, it is possible to improve precision of the reciprocating guide function for the movable blade 5, and to maintain the sharpness of the blade.

Figure 6:
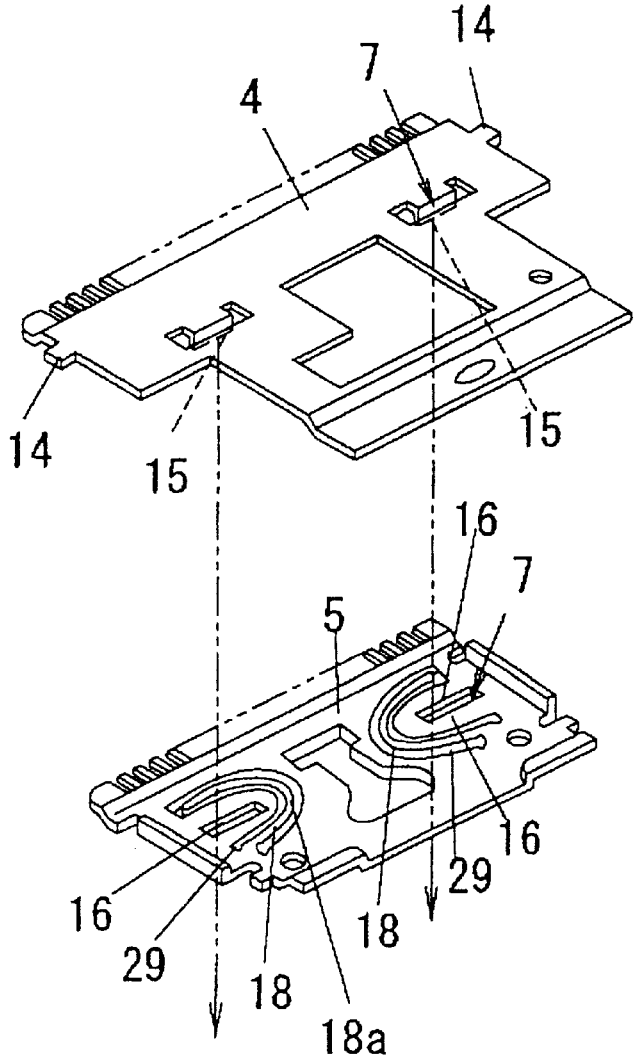
FIG. 6 is an exploded perspective view of a blade block according to a second embodiment of the present invention.
Figure 7:
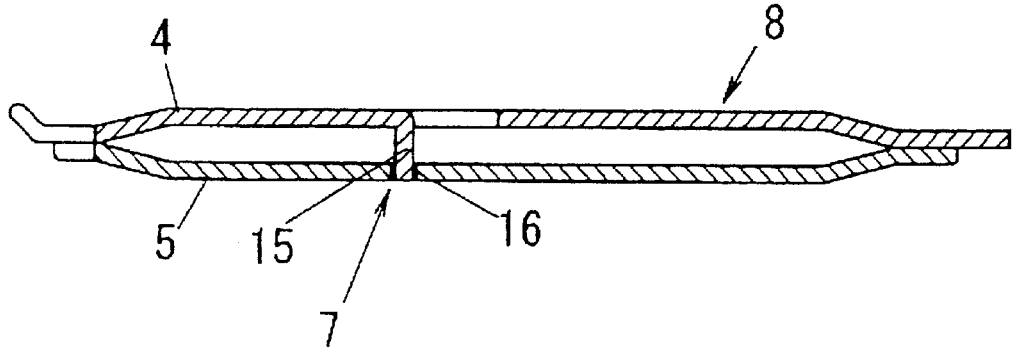
FIG. 7 is a cross-sectional view of the blade block according to the second embodiment of the present invention.

FIGS. 6 and 7 illustrate a second embodiment. The basic structure of the second embodiment is the same as that of the first embodiment. Accordingly, the common parts are given the same reference numerals as those of the first embodiment, and the detailed description of the common parts is omitted.

In the second embodiment, the guide pieces 15 are formed parallel to the reciprocating movement direction of the movable blade 5 and are formed by lancing (i.e., cutting and bending). The guide pieces 15 are inserted into slot-shaped guide holes 16.

In the second embodiment, since the guide pieces 15 are formed parallel to the reciprocating movement direction of the movable blade 5, guiding of the movable blade 5 in the reciprocating movement direction is efficiently performed. Further, the strength due to the thickness of the guide pieces 15 can suppress the backlash (flexing and bending) in the direction toward the cutting edge of the blade. Thus, the guiding precision can be improved. Further, since the guide pieces 15 are formed parallel to the reciprocating movement direction of the movable blade 5, the broken (or cut) face of the guide pieces 15 does not contact the edge of the guide holes 16. Thus, the roughness of the broken (or cut) face of the guide pieces 15 does not affect the guiding function.

Figure 8:
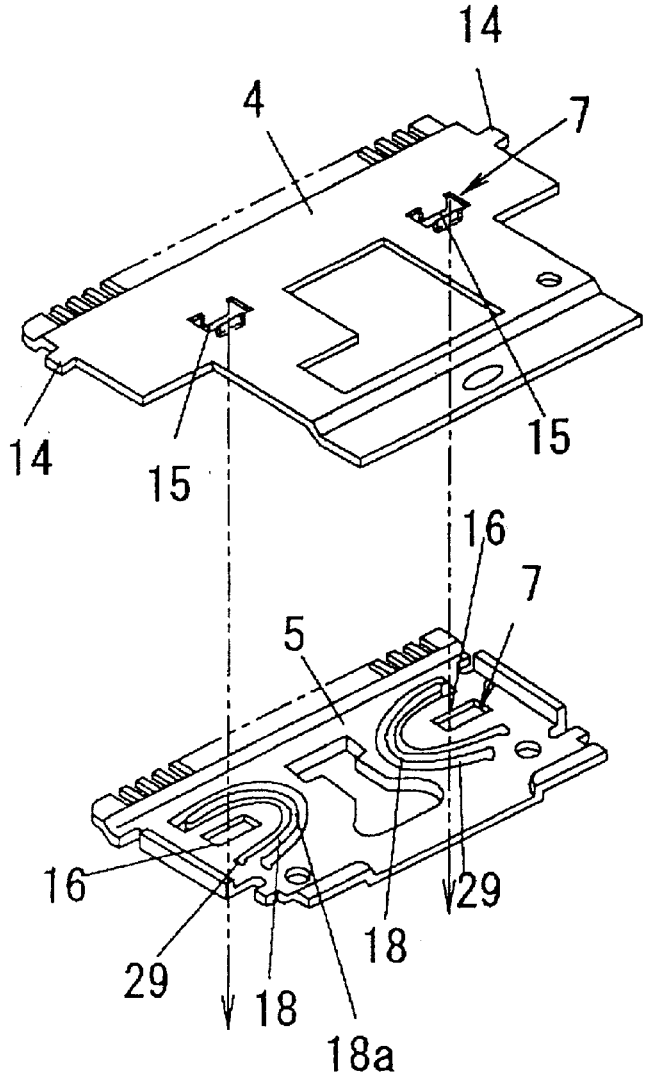
FIG. 8 is an exploded perspective view of a blade block according to a third embodiment of the present invention.
Figure 9:
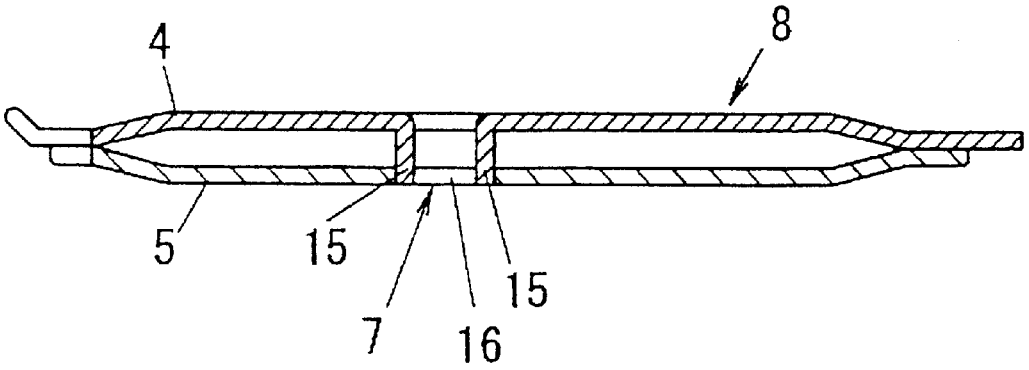
FIG. 9 is a cross-sectional view illustrating the blade block according to the third embodiment of the present invention.

FIGS. 8 and 9 illustrate a third embodiment of the present invention. The basic structure of the third embodiment is the same as that of the first or second embodiment. Accordingly, common parts have the same number as those of the above-described embodiments, and the detailed description of the common parts is omitted.

In the third embodiment, two guide pieces 15 extend in parallel with each other and are spaced from each other in a direction perpendicular to the reciprocating movement direction of the movable blade 5. The two guide pieces 15 slidably contact facing edges of the guide holes 16, respectively.

In the third embodiment, since a pair of guide pieces 15 extend in parallel with each other and are spaced from each other in the direction extending toward the cutting edge of the blade, the guiding strength of the mechanism substantially doubles. In addition, since a pair of guide pieces 15 are provided in parallel, each guide piece 15 does not require high size precision. Thus, the size precision can have large tolerances.

Figure 10A:
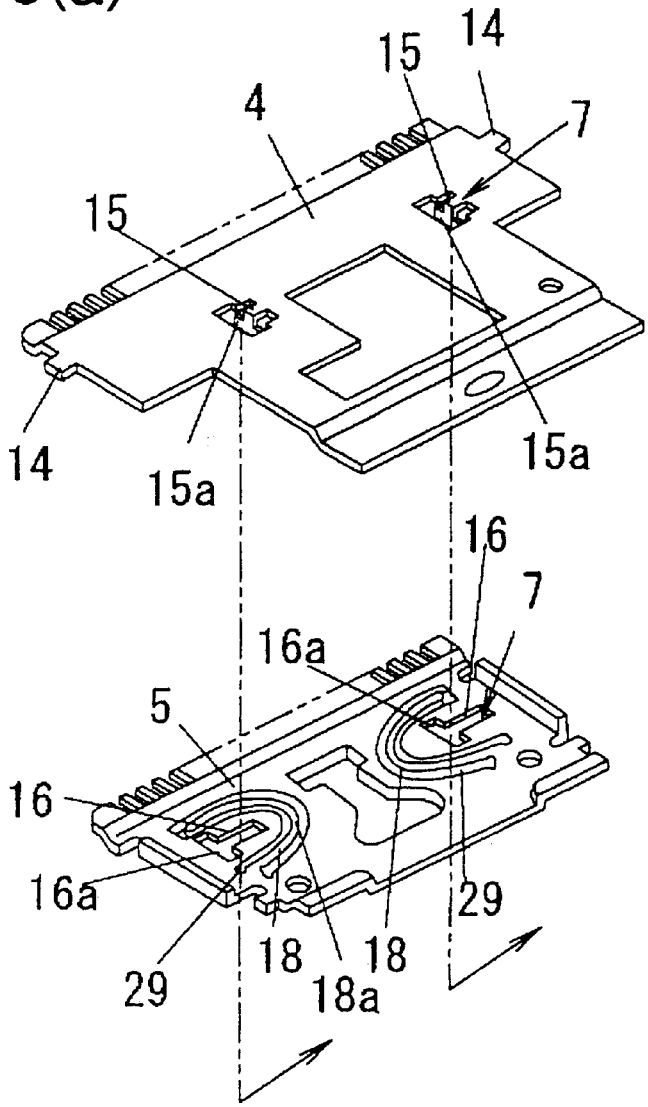
FIGS. 10(*a*) and 10(*b*), respectively, are an exploded perspective view and an enlarged partial perspective view of a blade block according to a fourth embodiment of the present invention.
Figure 10B:
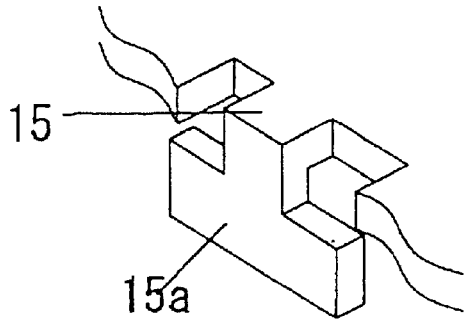

FIGS. 10(*a*) and 10(*b*) illustrate a fourth embodiment of the present invention. The basic structure of the fourth embodiment is the same as those of the embodiments described above. Accordingly, common parts have the same reference numerals as those of the above-described embodiments, and the detailed description of the common parts is omitted.

In the fourth embodiment, the guide pieces 15 are bent in a direction perpendicular to the reciprocating movement direction of the movable blade 5, and opposite edges in the width direction of each guide piece 15 slidably contact the opposing edges in the width direction of the guide hole 16 formed in the movable blade 5.

In the fourth embodiment, since each guide piece 15 is guided at the opposite edges in the width direction of the guide piece 15, the strength in the direction toward the cutting edge of the blade can be improved sufficiently. The strength to support the movable blade 5 against the loads at the time of the hair cutting can be improved and backlash can be avoided.

Further, in the fourth embodiment, a large width portion 16*a* is formed at one end of the guide hole 16 formed in the movable blade 5 so that the guide hole 16 has a keyhole shape, and a stopper portion 15*a*, which is smaller than the large width portion 16*a* and is larger than the width of the guide hole 16, is formed at the tip of the guide piece 15.

According to the construction described above, since the stopper portion 15*a* is inserted into the guide hole 16 through the large width portion 16*a*, the fixed blade 4 is prevented from separating from the movable blade 5, and thus the blade unit 8 is prevented from falling apart.

Figure 11:
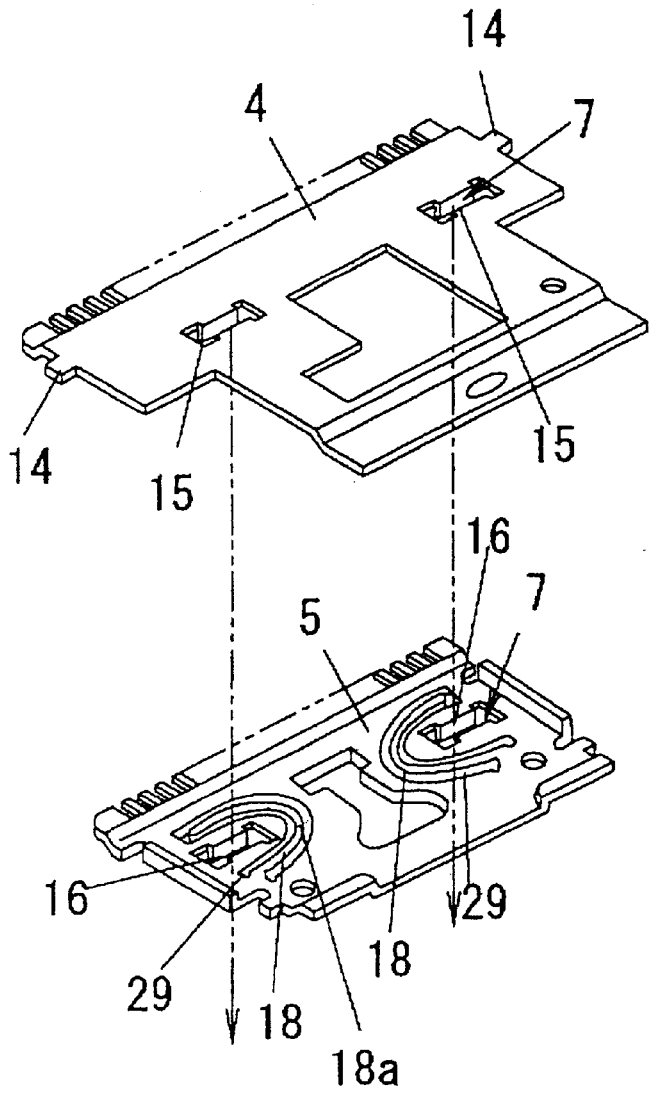
FIG. 11 is an exploded perspective view illustrating a blade block according to a fifth embodiment of the present invention.
Figure 12:
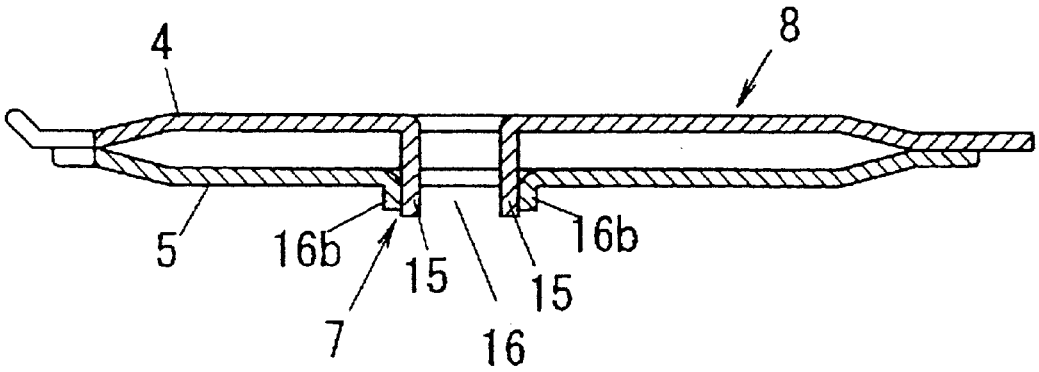
FIG. 12 is a cross-sectional view of the blade block according to the fifth embodiment of the present invention.

FIGS. 11 and 12 illustrate a fifth embodiment. Since the basic structure of the fifth embodiment is the same as those of the embodiments described above, the common parts have the same reference numerals as those of the above-described embodiments and the detailed description of the common parts is omitted.

In the fifth embodiment, bent portions 16*b* are provided at the opposing edges of the guide hole 16. Further, the guide pieces 15 are bent toward the same direction as that of the bent portions 16*b* of the guide hole 16.

In the fifth embodiment, since the bent portions 16*b* provided at the opposing edges of the guide hole 16 slidably contact the guide pieces 15, the guide pieces 15 are not guided by the broken or cut face of the guide hole 16. Thus, the guiding function becomes stable and unusual noise is prevented from occurring. Further, since a bent surface is formed at the bent portion 16*b* of the guide hole 16, an introducing area for the guide pieces is simultaneously and naturally formed with the bent portion 16*b*. In addition, when the bending angle of each of the opposing bent portions 16*b* is less than 90°, the amount of press fitting of the opposing guide pieces 15 can be set (or adjusted) so that a predetermined guide function can be obtained. Thus, the guide piece 15 and the guide hole 16 do not require high size precision, and the tolerance of the forming process can be made large.

Figure 13:
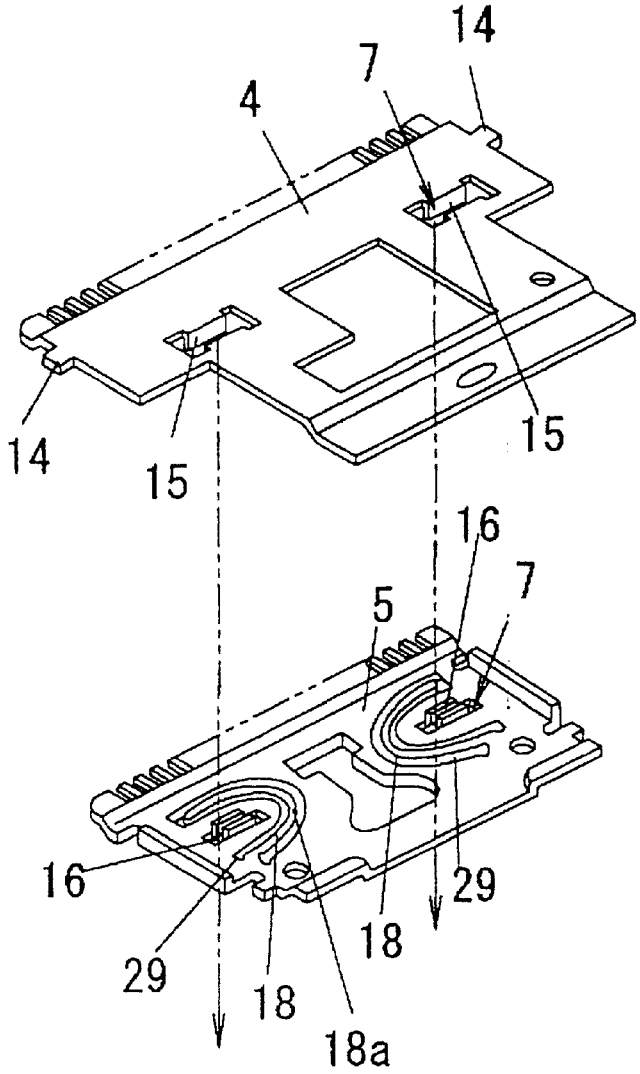
FIG. 13 is an exploded perspective view illustrating a blade block according to a sixth embodiment of the present invention.
Figure 14:
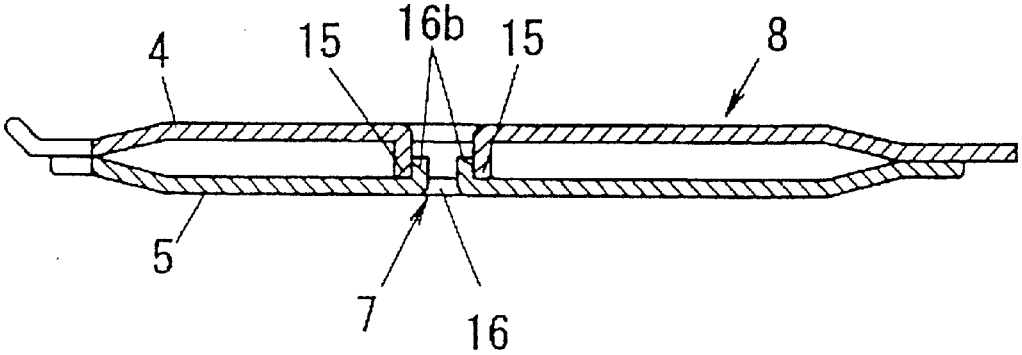
FIG. 14 is a cross-sectional view illustrating the blade block according to the sixth embodiment of the present invention.
Figure 15A:
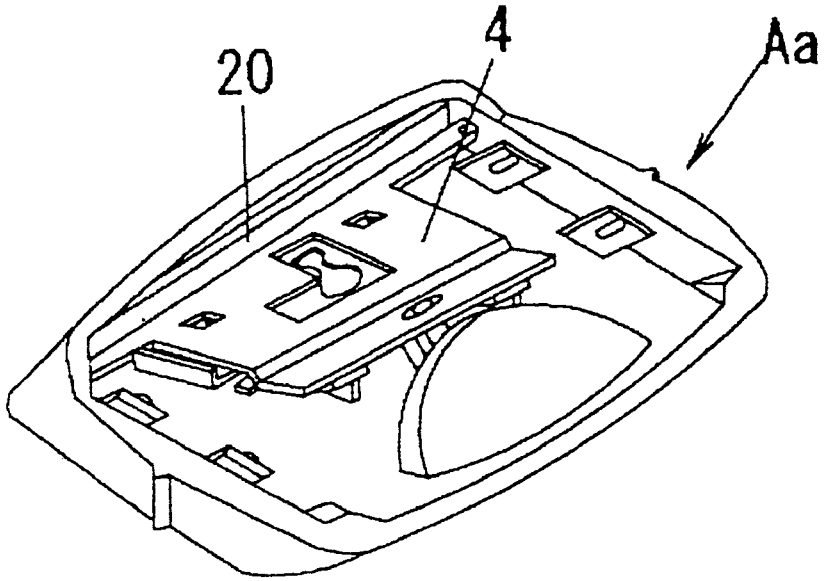
FIGS. 15(*a*) and 15(*b*), respectively, are a perspective view viewed from a back (inner) side of a conventional blade block, and an exploded perspective view of the conventional blade block.
Figure 15B:
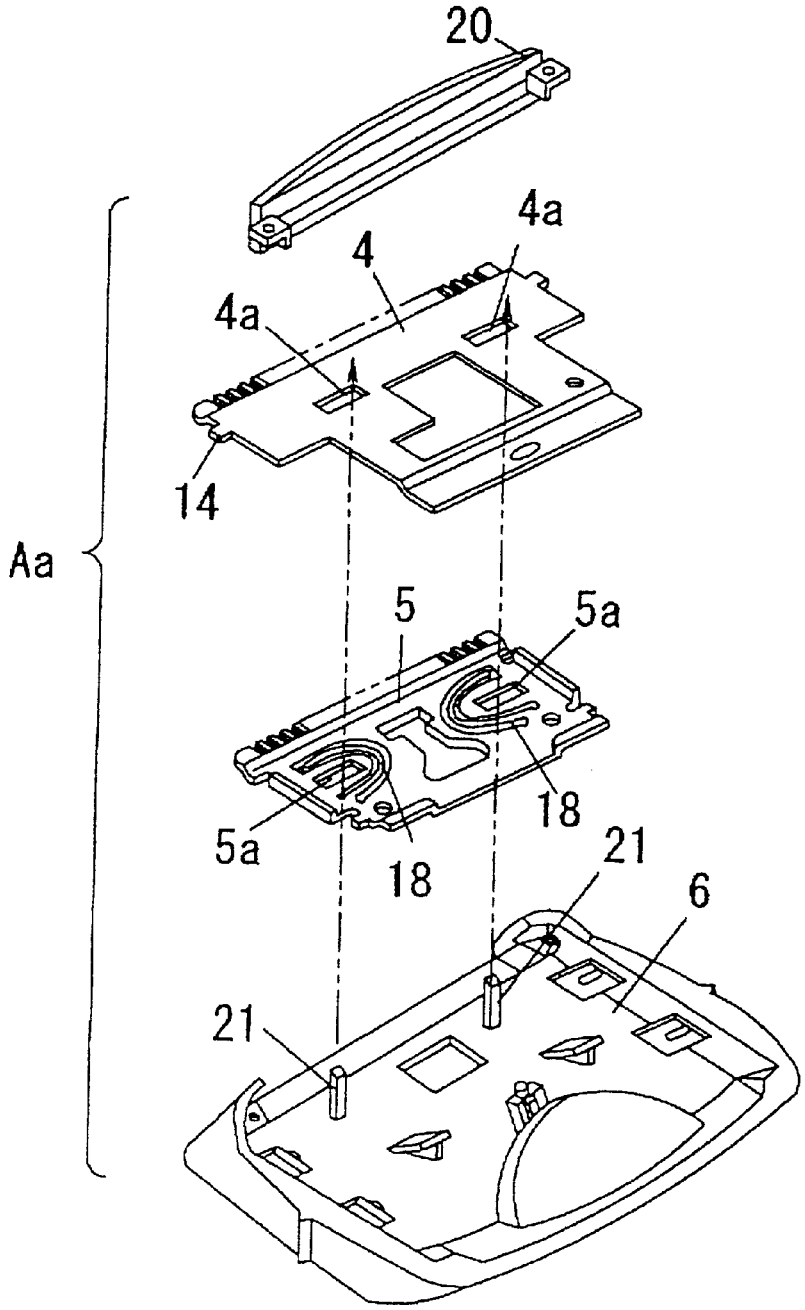

FIGS. 13 and 14 illustrate a sixth embodiment of the present invention. The basic structure of the sixth embodiment is the same as those of the embodiments described above. Accordingly, the common portions have the same reference numerals as those of the above-described embodiments, and the detailed description of the common parts is omitted.

In the sixth embodiment, the guide pieces 15 and the bent portion 16*b* of the guide hole 16 are bent so as to face each other (i.e., extend in opposite or opposing directions).

In the sixth embodiment, the guide pieces 15 slidably contact the bent portions 16*b*, which face the guide pieces 15, so as to guide them. Accordingly, the height of the guide pieces 15 can be short, and thus, the thickness of the blade unit 8 can be thin. In addition, since the bent portions 16*b* are bent toward the guide pieces 15, the blade base 6 does not require a portion to allow for the bent portion 16*b* to extend into. Further, for example, when the opposing bent portion 16*b* is bent toward the guide hole 15 so that the bending angle is set more than 90 degrees, a taper toward the bent portions (i.e., toward the movable blade 5) can be sharp. Thus, when the opposing bent portions 16*b* engage with the guide pieces 15, which face the bent portions 16*b*, efficiency of assembling the blade block can be improved.

It is noted that the foregoing examples have been provided merely for the purpose of explanation and are in no way to be construed as limiting of the present invention. While the present invention has been described with reference to certain embodiments, it is understood that the words which have been used herein are words of description and illustration, rather than words of limitation. Changes may be made, within the purview of the appended claims, as presently stated and as amended, without departing from the scope and spirit of the present invention in any or all of its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

The present disclosure relates to subject matter contained in priority Japanese Application No. 2000-16407, filed on Jan. 26, 2000, which is herein expressly incorporated by reference in its entirety.

What is claimed is:

1. A blade block of a hair cutter, the blade block comprising:

a blade unit including a fixed blade and a movable blade coupled by a reciprocating guide that enables the movable blade to reciprocate with respect to the fixed blade;

a plurality of guide pieces provided on the fixed blade;

a blade base defining an insertion opening; and a mounting unit that enables the blade unit to be mounted to the blade base when the blade unit is inserted into the insertion opening, so that a cutting edge of the blade unit extends toward and is exposed to outside.

2. The blade block of a hair cutter according to claim 1, further comprising a skin contact surface provided in an outer surface of the blade base, wherein the cutting edge of the blade unit inserted into the insertion opening is inclined with respect to the skin contact surface.

3. The blade block of a hair cutter according to claim 1, wherein the blade base includes a base plate;

a wall portion provided at a periphery of the base plate;

a corner portion formed between the base plate and the wall portion, wherein the insertion opening is provided in a vicinity of the corner portion.

4. The blade block of a hair cutter according to claim 1, further comprising at least one stopper provided at each opposing side edge of the fixed blade, the stopper positioning the fixed blade with respect to the blade base.

5. A blade block of a hair cutter, the blade block comprising:

a blade unit including a fixed blade and a movable blade coupled by a reciprocating guide that enables the movable blade to reciprocate with respect to the fixed blade;

a blade base defining an insertion opening; and a mounting unit that enables the blade unit to be mounted to the blade base when the blade unit is inserted into the insertion opening, so that a cutting edge of the blade unit extends toward and is exposed to outside, wherein the fixed blade includes at least one guide piece so as to enable the movable blade to reciprocate with respect to the fixed blade, the at least one guide piece comprising the reciprocating guide.

6. The blade block of a hair cutter according to claim 5, wherein the at least one guide piece is configured to be formed by cutting and bending.

7. The blade block of a hair cutter according to claim 5, wherein the at least one guide piece extends in parallel with a reciprocating movement direction of the movable blade, so that the at least one guide piece guides the movable blade by surface contact with the movable blade while the movable blade reciprocates.

8. The blade block of a hair cutter according to claim 7, wherein the at least one guide piece comprises a plurality of guide pieces extending in parallel with each other, and spaced from each other in a direction perpendicular to the reciprocating movement direction of the movable blade.

9. The blade block of a hair cutter according to claim 5, wherein the at least one guide piece extends in a direction perpendicular to a reciprocating movement direction of the movable blade, so that opposite edges of the at least one guide piece in a width direction thereof slidably contact facing edges spaced in the width direction of a guide hole formed in the movable blade, respectively.

10. The blade block of a hair cutter according to claim 7, wherein the movable blade has a guide hole elongated in the reciprocating movement direction, and a widened opening at one end of the guide hole, and wherein a stopper portion, which is smaller than the widened opening and is larger than the width of the guide hole, is provided at a tip of the guide piece.

11. A blade block of a hair cutter, the blade block comprising:

a blade unit including a fixed blade and a movable blade coupled by a reciprocating guide that enables the movable blade to reciprocate with respect to the fixed blade;

a blade base defining an insertion opening; and a mounting unit that enables the blade unit to be mounted to the blade base when the blade unit is inserted into the insertion opening, so that a cutting edge of the blade unit extends toward and is exposed to outside, wherein the reciprocating guide includes a guide hole provided in the movable blade, a guide piece projecting from the fixed blade and slidably moving with respect to the guide hole, and a bent portion provided at an edge of the guide hole.

12. The blade block of a hair cutter according to claim 11, wherein the guide piece and the bent portion of the guide hole extend toward opposite directions so as to face each other.

13. The blade block of a hair cutter according to claim 12, wherein the bent portion is bent more than 90 degrees.

14. The blade block of a hair cutter according to claim 11, wherein the guide piece and the bent portion of the guide hole extend in a same direction.

15. The blade block of a hair cutter according to claim 14, wherein the bent portion is bent less than 90 degrees.

16. A blade block of a hair cutter, the blade block comprising:

a blade unit including a fixed blade and a movable blade coupled by a reciprocating guide that enables the movable blade to reciprocate with respect to the fixed blade;

a blade base defining an insertion opening;

a mounting unit that enables the blade unit to be mounted to the blade base when the blade unit is inserted into the insertion opening, so that a cutting edge of the blade unit extends toward and is exposed to outside; and an insertion guide portion provided on the blade base that guides the blade unit when the blade unit is assembled to the blade base by insertion of the blade unit into the insertion opening of the blade base.

17. A blade block of a hair cutter, the blade block comprising:

a blade unit including a fixed blade and a movable blade coupled by a reciprocating guide that enables the movable blade to reciprocate with respect to the fixed blade;

a blade base defining an insertion opening;

a mounting unit that enables the blade unit to be mounted to the blade base when the blade unit is inserted into the insertion opening, so that a cutting edge of the blade unit extends toward and is exposed to outside;

a spring provided in the blade unit; and an introducing portion provided on the blade base to introduce the spring to the blade base.

18. The blade block of a hair cutter according to claim 17, wherein the spring includes a flat surface portion and corners of peripheral side surfaces of the spring being rounded.

19. A blade block of a hair cutter, the blade block including a fixed blade and a movable blade reciprocating with respect to the fixed blade, the blade block being detachably mounted to a hair cutter body, the blade block comprising:

a reciprocating guide including at least one guide piece projecting from the fixed blade, and at least one guide hole provided in the movable blade; and a blade base defining an insertion opening configured to receive the fixed blade and the movable blade, wherein the at least one guide piece is configured to be inserted into the at least one guide hole so that the movable blade can reciprocate within a range defined by a size of the guide hole.

* * * * *